US006971860B2

(12) United States Patent
Gilliam et al.

(10) Patent No.: US 6,971,860 B2
(45) Date of Patent: Dec. 6, 2005

(54) COMPRESSOR UNIT HOUSING

(75) Inventors: David Rex Gilliam, Bristol, VA (US); Steve Edwin Marshall, Abingdon, VA (US); David Turner Monk, Bristol, VA (US); Benjamin Alan Majerus, Bristol, VA (US); Scott Garrison Hix, Bristol, VA (US); Robert Bruce Peters, Bristol, VA (US); John Kenneth Narney, II, Bristol, VA (US); Eugene Karl Chumley, Abingdon, VA (US); William Thomas Wright, Bristol, VA (US); Richard Lynn Smith, Kingsport, TN (US)

(73) Assignee: Bristol Compressors, Inc., Bristol, VA (US)

( * ) Notice: Subject to any disclaimer, the term of this patent is extended or adjusted under 35 U.S.C. 154(b) by 70 days.

(21) Appl. No.: 10/428,524

(22) Filed: May 2, 2003

(65) Prior Publication Data

US 2004/0219034 A1 Nov. 4, 2004

(51) Int. Cl.[7] ..... F04B 39/12
(52) U.S. Cl. ..... 417/423.14; 417/902
(58) Field of Search ..... 417/423.14, 902

(56) References Cited

U.S. PATENT DOCUMENTS 4,345,882 A 8/1982 Saito et al.
4,352,642 A * 10/1982 Murayama et al. ..... 417/902
4,384,635 A 5/1983 Lowery
4,406,590 A 9/1983 Kessler
4,412,791 A 11/1983 Lal
4,576,555 A * 3/1986 Ashenfelter ..... 417/902
4,729,723 A 3/1988 Outzen
5,252,038 A * 10/1993 Mangyo et al. ..... 417/902
5,281,105 A 1/1994 Osaka et al.
D366,488 S 1/1996 Alfano et al.
5,487,648 A * 1/1996 Alfano et al. ..... 417/902
5,538,404 A 7/1996 DiFlora et al.
5,762,479 A 6/1998 Baars et al.
6,035,963 A 3/2000 Wollitz
6,413,056 B1 7/2002 Chou
2003/0003003 A1 1/2003 Leonhard

FOREIGN PATENT DOCUMENTS

JP 6-50262 2/1994

* cited by examiner

*Primary Examiner*—Michael Koczo, Jr.
(74) *Attorney, Agent, or Firm*—McNees Wallace & Nurick LLC; Kurt L. Ehresman

(57) ABSTRACT

A hermetic compressor unit housing comprised of a shell having a top section and a bottom section which receives the top section, the shell being formed of sheet metal and having generally cylindrical sidewalls wherein the sidewall taken in a generally axial direction is substantially straight, each shell section having an opening, a substantially cylindrical portion, and a closed end portion, the opening having a substantially circular horizontal cross-sectional geometry defined by a major axis and a minor axis, the horizontal cross-sectional geometry including substantially liner opposing sidewall portions preferably disposed adjacent to the intersection of the horizontal sectional geometry with the minor axis, and methods of aligning the shell sections for installation of fixtures and mating of the shell sections.

13 Claims, 9 Drawing Sheets

COMPRESSOR UNIT HOUSING

BACKGROUND OF THE INVENTION

The invention concerns refrigeration or air conditioning compressor units of the hermetically sealed type wherein the compressor housing or "shell" encloses the compressor, its drive motor and accessories. The compressor housing has upper and lower cup shaped sections which sections are secured together, e.g., by welding along the peripheral mating joint formed by the mated contiguous opening portions of the shell sections after the compressor, motor, and accessories are mounted therein.

It is customary in the design and manufacture of hermetically sealed compressors to dimension and configure the shell sections to adequately accommodate, spacewise, the compressor, its motor, and the various auxiliary components such as the motor mounting, the suction feed system, the discharge loop, the discharge muffler, and the like. Often other design needs, such as diminishing the inherent property of the shell to transmit objectionable noise at objectionable frequencies, are compromised by paramount space considerations such as the dimensioning and configuration of the refrigeration or air conditioning system housing or cabinet into which the compressor unit is to be mounted. Also, the shell manufacturing techniques such as deep-draw press operations frequently necessitate certain shell configurations such as substantially straight, cylindrical side walls. Due to widely varying shell configurations, it is becoming increasingly difficult to align the shell sections for accurate and precise location, positioning and installation of fixtures such as junction boxes, intakes, exhausts, mounting brackets, feet, and the like. Similarly, alignment of the shell sections for mating and securing has become problematic.

DISCUSSION OF THE PRIOR ART

The patent literature describes many different variations of compressor unit shell configurations, e.g., U.S. Pat. Nos. 4,239,461; 4,384,635; 4,396,360; 4,406,590; 4,412,791; 4,729,723; 5,281,105; 5,538,404; and 5,762,479. Many of these patents are directed to reducing objectionable noise transmitted by the shell. The objectionable noise is frequently originated or propagated in the shell either by the mechanical elements of the compressor such as the suction and discharge valves, or by the refrigerant flowing through the compressor, e.g., pulsations within the suction or discharge system. In this regard, it is recognized by those skilled in the art that the source of the noise, its mode of propagation within the shell, and its manner of transmission by the shell to the human ear are all extremely difficult to understand and predict, and of course, to control. The above referenced patents describe a myriad of shell shapes, both symmetric and asymmetric, in attempts to control the generation and propagation of vibration and noise, as well as to control the size of the assembled shell.

As compressor housings have become increasingly complex in shape, manufacturers find it increasingly difficult and expensive to securely and reliably orient the shells for accurate and precise positioning and installation of fixtures such as junction boxes, intakes, exhausts, ports, orifices, brackets, mountings, and the like, and also for the mating and securing of the shell sections. Improper location of fixtures caused by improper alignment of the shell sections can result in shell contact with internal compressor parts, resulting in unwanted noise, vibration, and friction. Improper alignment during the mating of the shell sections can compromise the integrity of the hermetic seal. It is therefore recognized by those skilled in the art that controllable, repeatable, precise and accurate alignment of the sections is desirable.

Known methods of alignment and positioning of shell sections are prone to error. Manufacturers currently engage in marking, pre-spot welding, and similar activities in order to locate, position, and install fixtures and to mate shell sections. Such labor-intensive measures do not produce inconsistent results, and are costly.

Therefore, what is needed is a precise, accurate and cost-effective method of aligning shell sections for fixture mounting and mating operations. Furthermore, what is also needed is a compressor unit housing or "shell" design which is easy to align for locating, positioning and installing of fixtures as well as for the mating of the shell sections.

SUMMARY OF THE INVENTION

In one embodiment of the present invention, the apparatus is a hermetic compressor housing unit comprising a shell having upper and lower sections which, when mated, form a generally cylindrical shell with substantially straight or linear sidewalls. Each shell section includes an open end ("opening"), a substantially cylindrical sidewall, and a closed end portion. Each shell section includes a generally circular or oval horizontal cross-sectional geometry defined by a major axis and a minor axis. The horizontal cross-sectional geometry includes a pair of substantially linear opposing portions disposed substantially perpendicular to and in proximity to the intersection of horizontal cross-sectional geometry with the minor axis. The pair of substantially linear opposing portions originate at the opening on the sidewall of the shell section and extend towards the closed end portion of the shell section. The substantially linear opposing portions can extend the entire length of the sidewall before being blended into the substantially circular or oval horizontal cross-sectional geometry at the closed end.

In another embodiment, the substantially linear opposing portions of a shell section are blended into the substantially circular or oval horizontal cross-sectional geometry before reaching the closed end portion. In this embodiment, the closed end portion and a portion of the sidewall can have a horizontal cross sectional geometry, e.g. circular, which differs from that of the horizontal cross sectional geometry of the sidewall at the opening, as a result of blending of the substantially linear opposing portions.

A further embodiment of the invention includes a method of aligning and assembling hermetic compressor shells having upper and a lower shell sections. The method includes comprises providing a hermetic compressor housing shell section having substantially straight sidewalls and a substantially circular or substantially oval horizontal cross-sectional geometry defined by a major axis and a minor axis. The method further provides applying force to at least two opposing points on the interior surface of the sidewalls in the direction of the major axis, such that the shell section becomes aligned along the major axis. In other embodiments, the method may further include the additional step of applying additional force to at least two points on the interior surface of the sidewalls in the direction of the minor axis, such that the shell section also becomes aligned along the minor axis.

After aligning the shell by application of force to at least two points on the interior surface of the sidewalls along the major axis or the major and minor axes, the method may further include the step of providing at least one fixture for installation on the shell section, and locating and positioning the at least one fixture based upon the alignment of the shell section. Proper locating and positioning of the fixture on the aligned shell section enables accurate and precise installation of the fixture to the shell section.

One advantage of the invention is that it provides a housing which is configured to accommodate many types of presently manufactured compressors, single or multiple cylinders, most preferably two cylinders, including their motors and the aforesaid auxiliary components, which compressors are typically employed in hermetic units. Another advantage of the invention is that it provides increased capacity for precise alignment of the shell sections. Yet another advantage is that the invention provides an improved shell design with substantially straight cylindrical side walls, which design is relatively inexpensive and easy to produce by conventional metal forming operations.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

The invention will be further understood from the following description and drawings which show a preferred embodiment of the present invention, wherein.

Wherever possible, the same reference numbers will be used throughout the drawings to refer to the same or like parts.

BRIEF DESCRIPTION OF THE PREFERRED EMBODIMENTS

The compressor shell or housing of the present invention preferably has a generally cylindrical shape, and is dimensioned to enclose a compressor, electric motor, and any corresponding auxiliary components such as a discharge muffler, suction line, motor cap or suction plenum having an inlet, and the like. A typical compressor having utility for the present invention is shown in U.S. Pat. No. 4,995,791, the disclosure of which is incorporated herein by reference.

Figure 1:
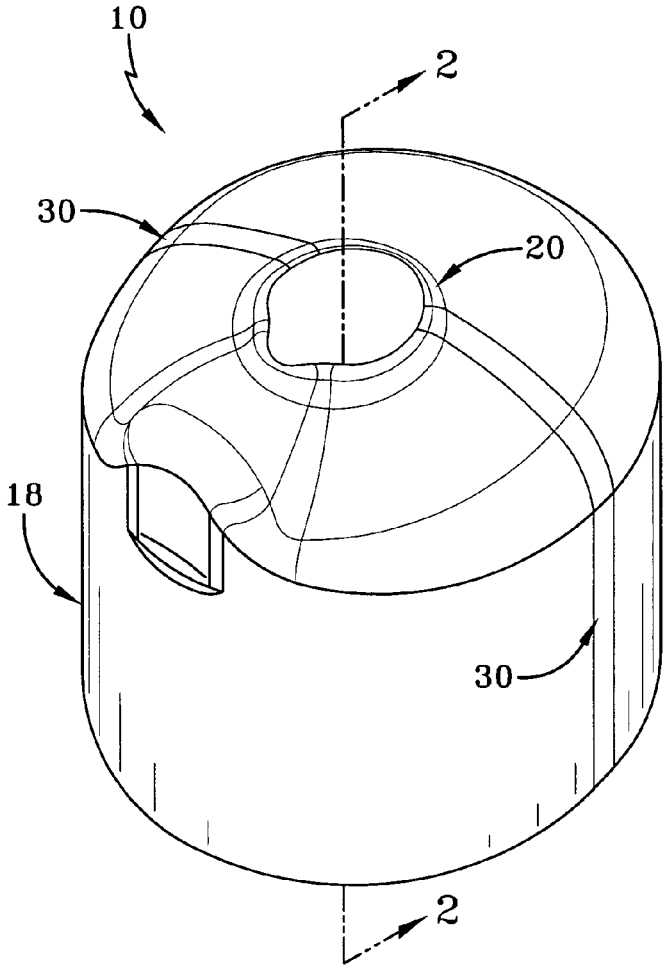
FIG. 1 is an elevational view of an upper shell section of the present invention.
Figure 2:
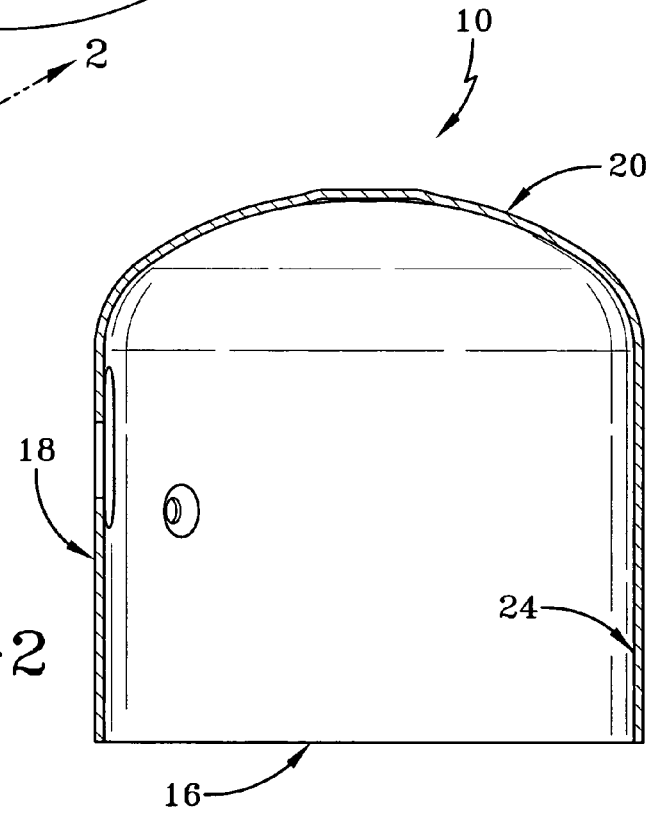
FIG. 2 is a side cross-sectional view of an upper shell section of the present invention.
Figure 3:
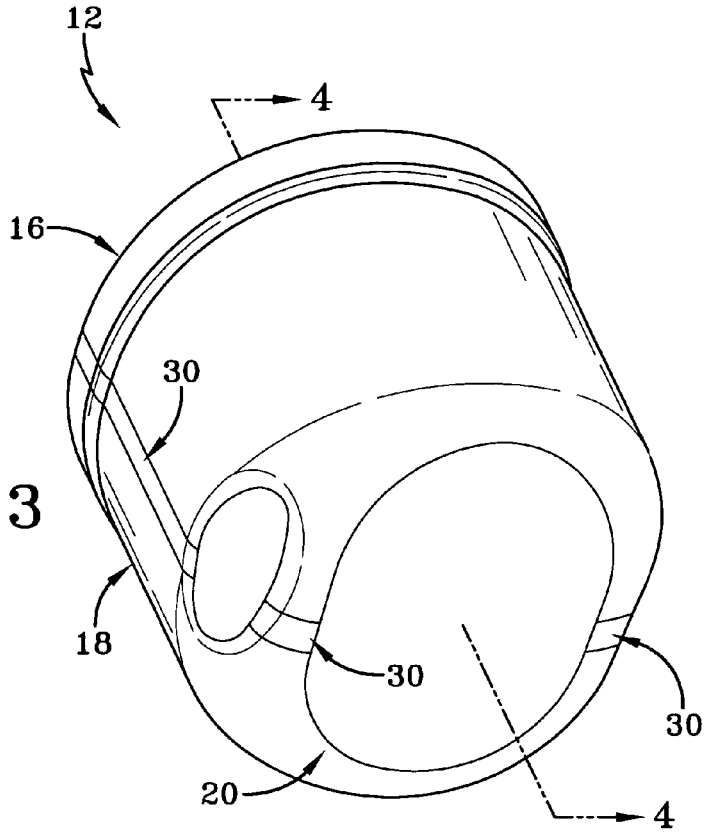
FIG. 3 is an elevational view of a lower shell section of the present invention.
Figure 4:
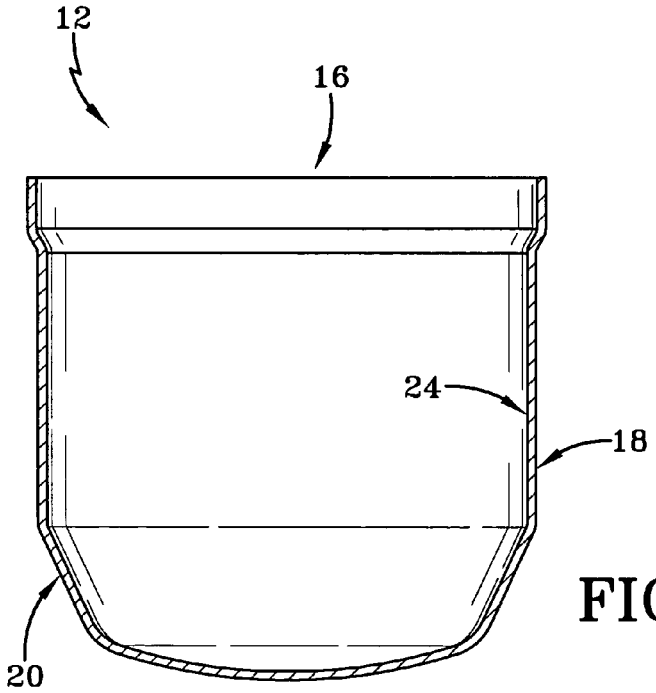
FIG. 4 is a side cross-sectional view of a lower shell section of the present invention.
Figure 10:
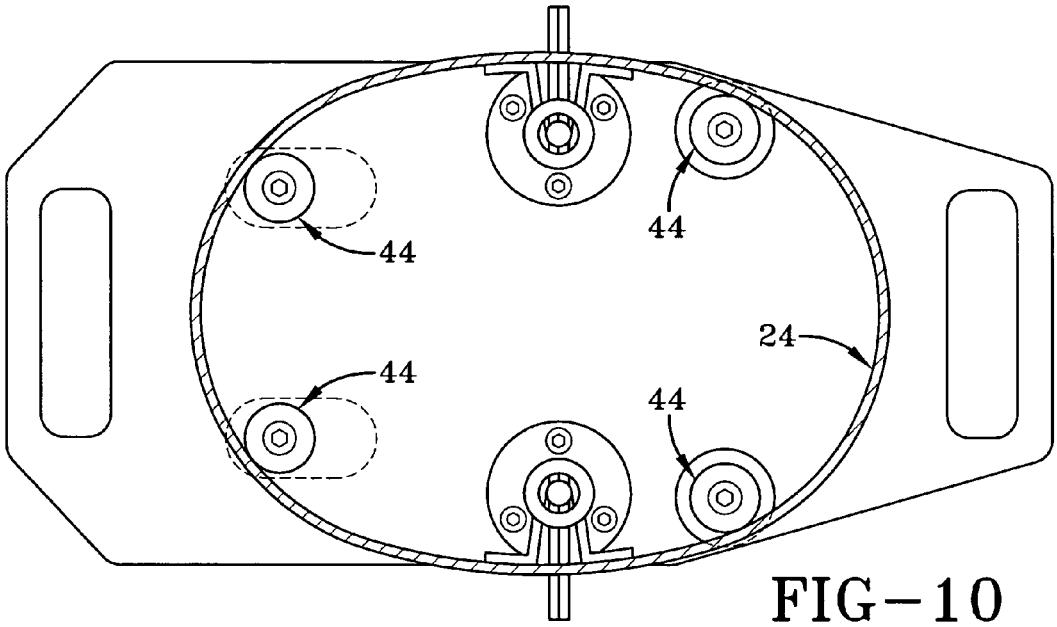
FIG. 10 is a cross-sectional top view of one embodiment of a force applying means for application of force to the interior surface of the sidewalls illustrated in FIG. 9 in accordance with the present invention.

Referring to the drawings, the compressor housing of the present invention includes two shell sections, an upper shell section 10 and a lower shell section 12, that are connected or secured together to form the housing. Each section 10, 12 is preferably formed by a metal drawing operation from low carbon sheet steel of a substantially uniform thickness, preferably from about 0.090 to about 0.160 in. It is to be understood that the sections 10, 12 can be formed by any suitable process and can have any suitable thickness. As shown in FIG. 1 and FIG. 2, the upper shell section 10 has an essentially cup or bowl shape with substantially linear sides. Similarly, the lower shell section 12 has an essentially cup or bowl shape with substantially linear sides as shown in FIGS. 3 and 4. As shown in FIGS. 1–4, each shell section 10, 12 includes an opening 16, a substantially cylindrical sidewall 18 extending from the opening 16, and a closed end portion 20 disposed opposite the opening 16. In a preferred embodiment, the opening 16 of the upper shell section 10 is adapted to nest or fit within the opening 16 of the lower shell section 20. for connection to the lower shell section 20. As shown in FIG. 10, the shell sections 10, 12 are preferably connected by welding to form the housing, although other suitable connection techniques can be used.

Figure 5:
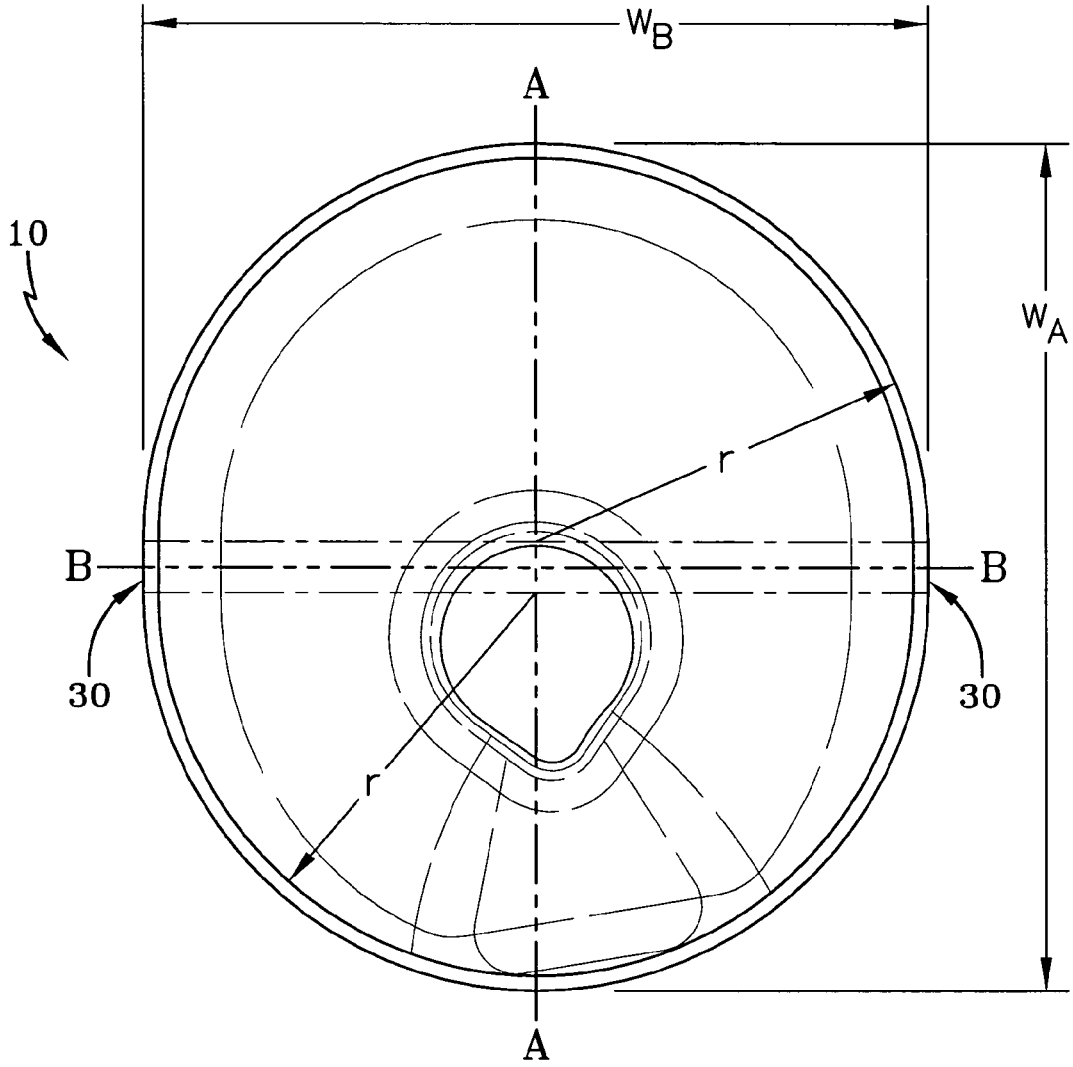
FIG. 5 is a horizontal bottom cross-sectional view of an upper shell section of the present invention.
Figure 6:
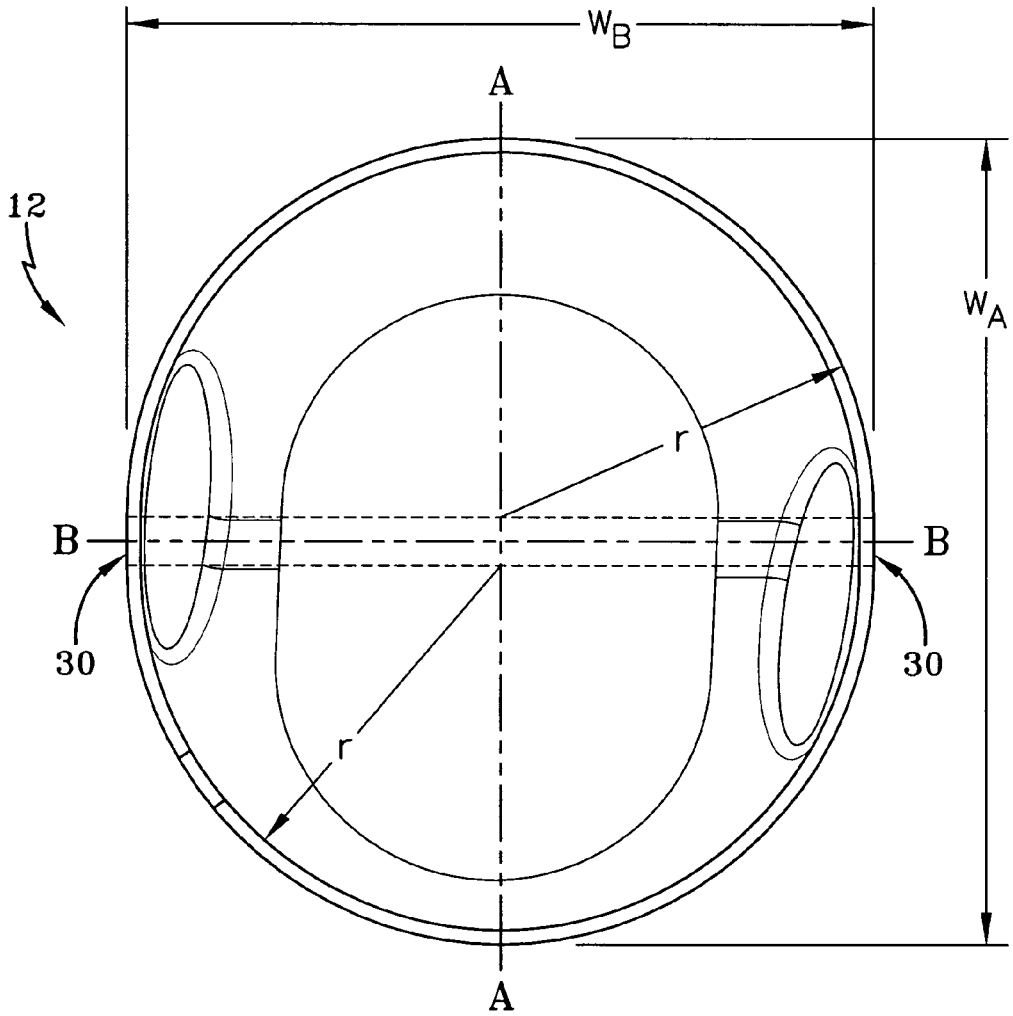
FIG. 6 is a horizontal top cross-sectional view of a lower shell section of the present invention.

As shown in FIG. 5 and FIG. 6, the opening 16 of each shell section 10, 12 has a generally circular or more preferably oval horizontal cross-sectional geometry. For purposes of this application, either of these shapes is termed herein as "generally circular." As shown in FIG. 5 and FIG. 6, the horizontal cross sectional geometry is defined by a major axis A—A and minor axis B—B and the length ratio along these axes is the ratio of the dimensions $W_A$ and $W_B$. The ratio WA/WB is preferably from greater than. 1.0 to about 1.6, and most preferably from about 1.2 to about 1.5.

The horizontal cross-sectional geometry of the opening 16 each shell section 10, 12 further includes a pair of substantially linear opposing segments or portions 30 preferably disposed substantially perpendicular to and in proximity to the intersection of the horizontal cross-sectional geometry with the minor axis. However, the linear opposing portions could be disposed at an angle to the minor axis. The cross-sectional length along the major axis of each substantially linear opposing portion 30 is from about between 0.250 inches to about 3.0 inches wide and is preferably about 1.0 inch wide. The opposing portions 30 are preferably centered at the intersection of the minor axis and the horizontal cross-sectional geometry of the opening 16. As further shown in FIG. 1 and FIG. 3, the pair of substantially linear opposing portions 30 originate at the opening 16 of each shell section 10,12 and extend in the sidewalls 18 towards the closed end portion 20 of the shell sections 10, 12.

In other embodiments, the shell may further include a pair of substantially linear opposing segments or portions disposed substantially perpendicular to and in proximity to the intersection of the horizontal cross-sectional geometry with the major axis. Such segments or portions may be supplement, or serve as an alternative to, linear segments or portions located in proximity to the intersection of the minor axis and the horizontal cross-sectional geometry.

In the embodiment shown in FIG. 1 and FIG. 3, the pair of substantially linear opposing portions 30 extend almost the entire length of the shell section 10,12 and the entire length of the sidewalls before being blended into the closed end portion 20. In this embodiment, the sidewalls 18 and at least a portion of the closed end portion 20 of each shell 10, 12 have the substantially circular horizontal cross-sectional geometry of the opening 16, which geometry is defined by a major axis and a minor axis, and includes substantially linear opposing portions 30 disposed substantially perpendicular to and in proximity to the intersection of the cross-sectional geometry with the minor axis.

In other embodiments, the substantially linear opposing portions 30 are blended into the general cross-sectional shape of the sidewall 18 before reaching the closed end portion 20. In this embodiment, the opening 16 and sidewall 18 of each shell 10, 12 have a substantially circular horizontal cross-sectional geometry defined by a major axis and a minor axis with substantially linear opposing portions 30. Furthermore, the remaining portion of the sidewall 18 and the closed end portion 20 may have a horizontal cross sectional geometry that is different from that of the opening 16, e.g. perfectly circular, as a result of the blending of the substantially linear opposing portions 30 sections.

Figure 7:
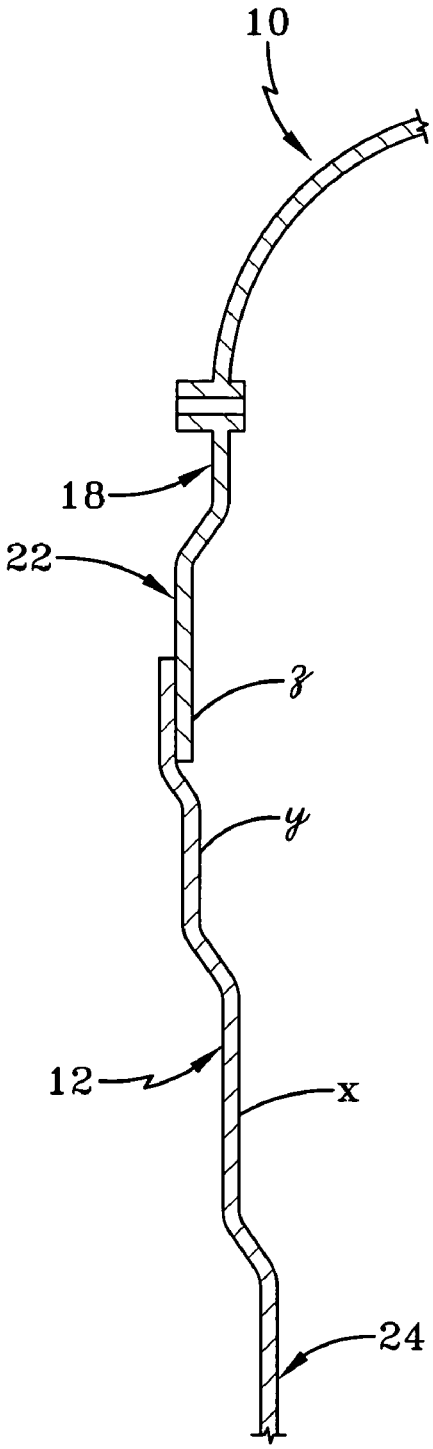
FIG. 7 is a cross-sectional view of the connection between the upper and lower shell sections.

The sidewall 18 of each shell section 10, 12 is preferably substantially straight or linear in an axial direction. The term "substantially straight" in this context permits a slight outward or inward bow on a substantially uniform radius should such a bow be desired at all. The origin of a slight outward bow may be located at any peripheral position around the sidewall 18 of the shell section, such that the radius is used to define the curvature, if any, of the sidewall 18. The length of the radius can be "substantially uniform" which means that the radius length for different small segments of a sidewall section can be changed for some specific purpose such as spatial requirements, without thereby deviating from the concept of giving a slight bow to the sidewall 18. In another embodiment, the sidewall 18 of each shell section 10, 12 may also be "stepped" inwardly or outwardly one or more times from the opening 16 toward the closed end portion 20 thereof, i.e., progressively or by steps of decreased or increased diameters. For example, FIG. 7 illustrates the steps as x, y and z. This "stepped" shell wall concept, such as shown in FIG. 7, is common for permitting the shell to be fitted within limited space areas of a refrigeration cabinet.

The present invention also includes methods of aligning and assembling hermetic compressor shells having an upper and a lower shell section with the substantially circular horizontal cross-sectional geometry previously described. The method can be preferably utilized in conjunction with the shell of the present invention. However, the method can also be used with shells having a horizontal cross-sectional geometries defined by a major axis and a minor axis.

Figure 8:
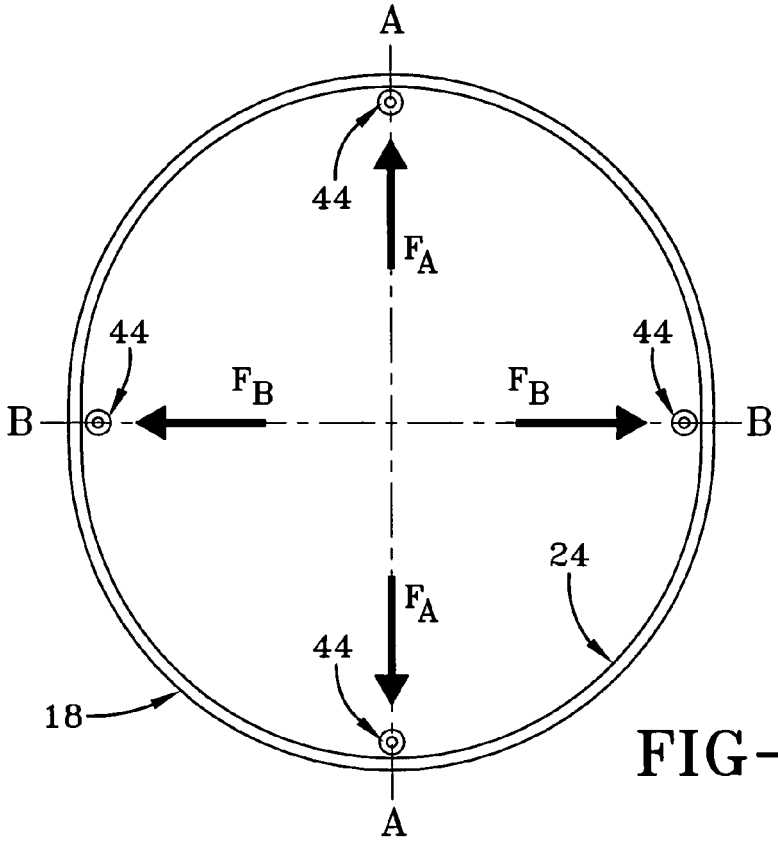
FIG. 8 shows the application of force to the interior surface of the sidewalls of a shell in accordance with one embodiment of the present invention.

The method comprises providing a hermetic compressor housing shell section having substantially straight sidewalls and having a horizontal cross-sectional geometry defined by a major axis and a minor axis, preferably the geometry shown in FIGS. 5 and 6. Next, a force $F_A$ is applied", to at least two opposing points on the interior surface of the sidewalls in the direction of the desired orientation of the major axis A—A shown in FIG. 8, such that the shell section becomes aligned along the major axis. The application of the force causes the shell to rotate until the major axis of the shell is aligned with the force $F_A$. The force $F_A$ can be applied to the interior shell surface by any force applying means known to those skilled in the art that permit the shell to rotate. As shown in FIG. 8, the force applying means 42 preferably includes at least two cylindrical rollers or wheels 44, each roller or wheel 44 rotatably mounted on an axle 46 adjustably connected to force exerting means 42, such as a hydraulic, spring, or scissors-operated jack or the like. One characteristic of the force applying means 42 is that as the force $F_A$ is increased, the rollers or wheels simultaneously contact and exert pressure on at least two points on the interior surface 24 of the sidewalls 18 of the shell section 10,12 forcing the shell section to rotate. When the shell section 10,12 has rotated such that the rollers or wheels reach the intersection of the sidewall 18 and the major axis A—A, the shell section 10,12 is properly aligned. At this point, a sufficient level of force continues to be applied so as to maintain proper shell alignment and prevent the shell section 10,12 from changing position. Optionally, a second force, $F_B$, can be applied to at least two points on the interior surface 24 of the sidewall 22 in the direction of the desired orientation of the minor axis B—B, forcing the shell section 10,12 to further rotate such that a second set of rollers or wheels rotate until reaching the intersection of the sidewall 18 and the minor axis so that the shell section 10,12 is also aligned along the minor axis.

Figure 9:
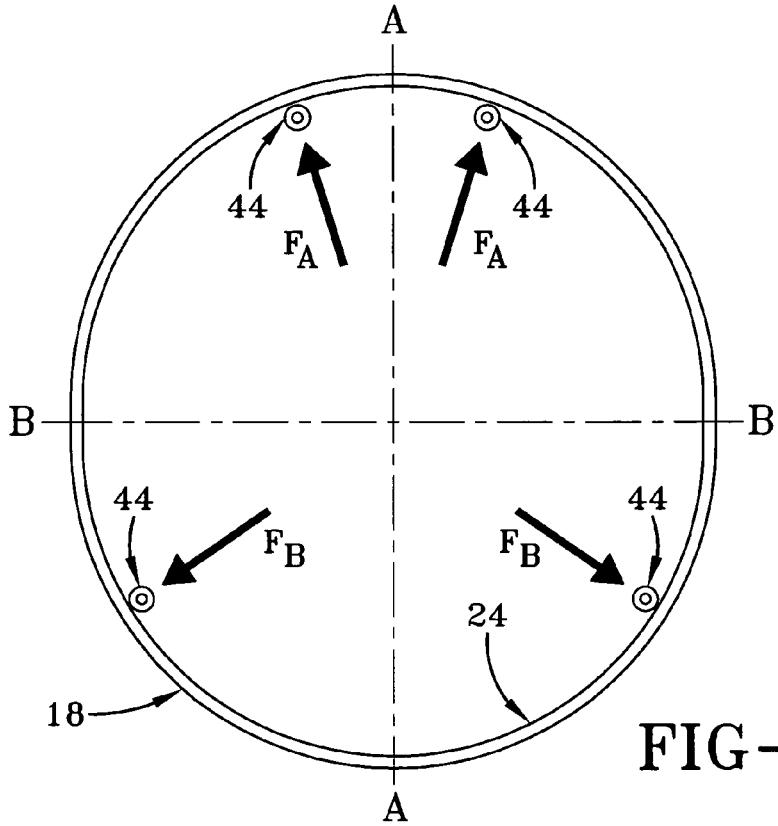
FIG. 9 shows the application of force to the interior surface of the sidewalls of a shell in accordance with a second embodiment of the present invention.
Figure 11:
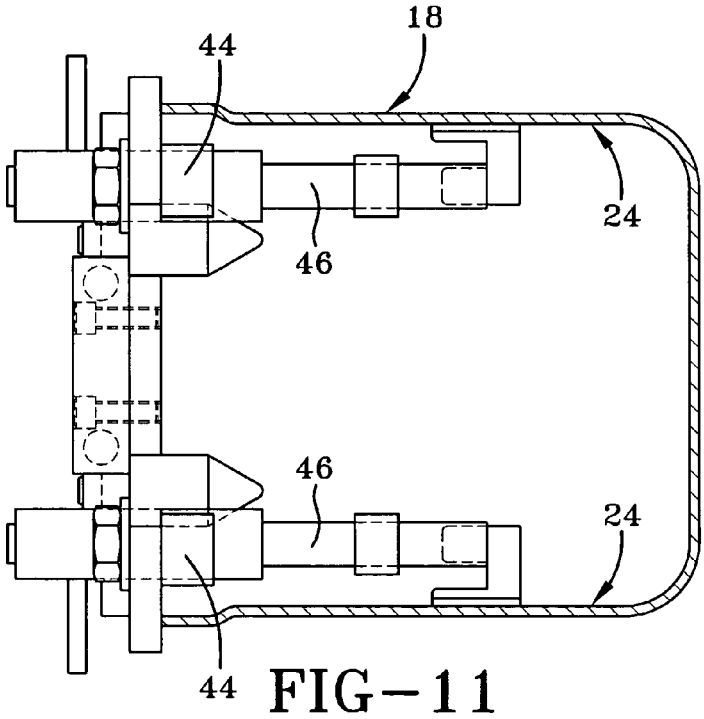
FIG. 11 is a side cross-sectional view of the embodiment of force applying means of FIG. 10.

Alternatively, as shown in FIG. 9, the primary force $F_A$ may be applied by two rollers which are offset to each side of the major axis, and the secondary force $F_B$ may be applied by two rollers or wheels 44 mounted on axles 46 which are offset to each side of the opposing end of the major axis. An exemplary force applying apparatus for practicing this method of alignment is illustrated in FIGS. 10 and 11.

Figure 12:
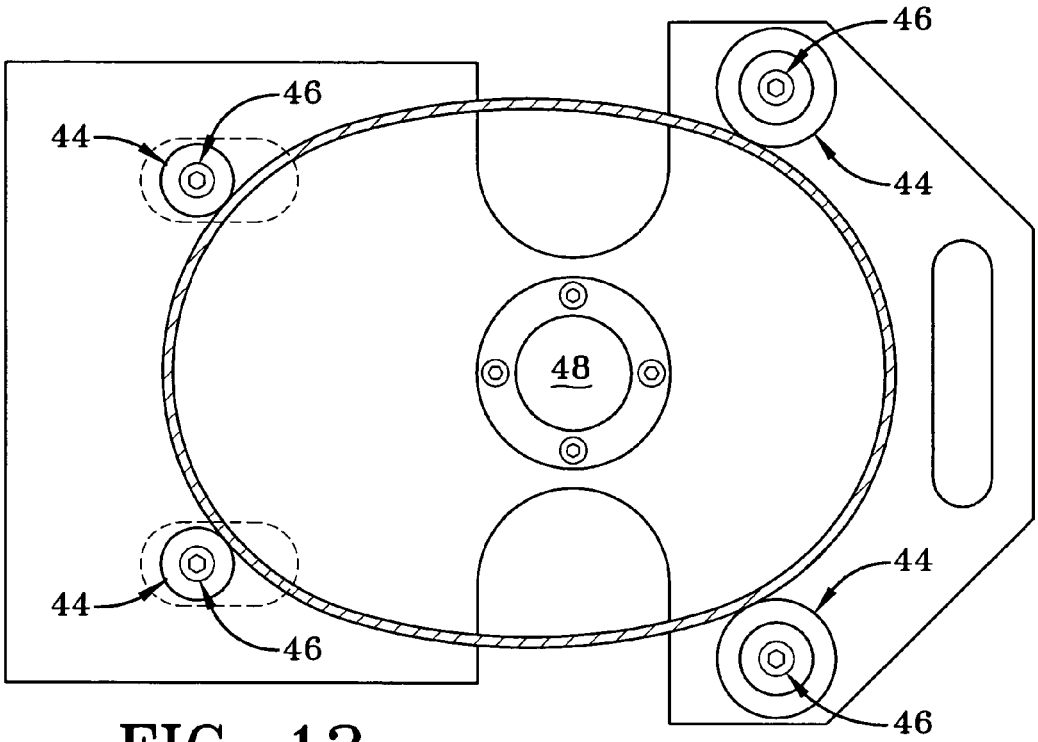
FIG. 12 shows a top cross-sectional view of a second embodiment of force applying means for application of force to the exterior surface of the sidewalls in accordance with the present invention.
Figure 13:
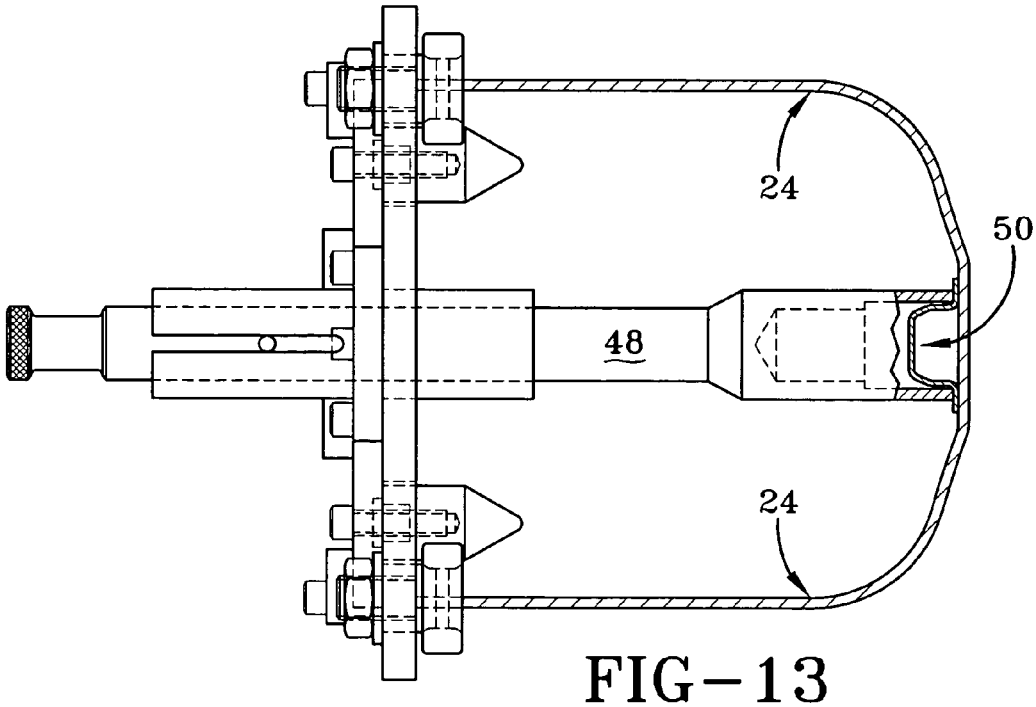
FIG. 13 shows a side cross-sectional view of the second embodiment of force applying means of FIG. 12.

In other embodiments, the method may involve application of force to the exterior surface of the sidewalls. In this embodiment, force $F_A$ is applied, to at least two opposing points on the exterior surface of the sidewalls in the direction of the desired orientation of the major axis A—A, such that the shell section becomes aligned along the major axis. The application of the force causes the shell to rotate until the major axis of the shell is aligned with the force $F_A$. The force $F_A$ can be applied to the exterior shell surface by any force applying means known to those skilled in the art that permit the shell to rotate. As in other embodiments, a characteristic of the force applying means is that as the force $F_A$ is increased, the rollers or wheels simultaneously contact and exert pressure on at least two points on the exterior surface of the sidewalls of the shell section forcing the shell section to rotate. When the shell section has rotated such that the rollers or wheels reach the intersection of the sidewall and the major axis A—A, the shell section is properly aligned. At this point, a sufficient level of force continues to be applied so as to maintain proper shell alignment and prevent the shell from changing position. Optionally, a second force, $F_B$, can be applied to at least two points on the exterior surface of the sidewall in the direction of the desired orientation of the minor axis B—B, forcing the shell section to further rotate such that a second set of rollers or wheels rotate until reaching the intersection of the sidewall and the minor axis so that the shell section is also aligned along the minor axis. An exemplary force applying apparatus for practicing this method of alignment is illustrated in FIGS. 12 and 13. As shown in FIG. 13, where the force applying means applies force to the outer surface of the side wall, the force applying means may also include an alignment arm 48 which extends into the opening 16 of the shell to engage the inner surface of the closed end portion 20. As shown in FIG. 13, preferably the alignment arm 48 engages a recessed cylindrical portion 50, spring mounting, or other protruding feature of the inner surface of the closed end portion 20.

Figure 14:
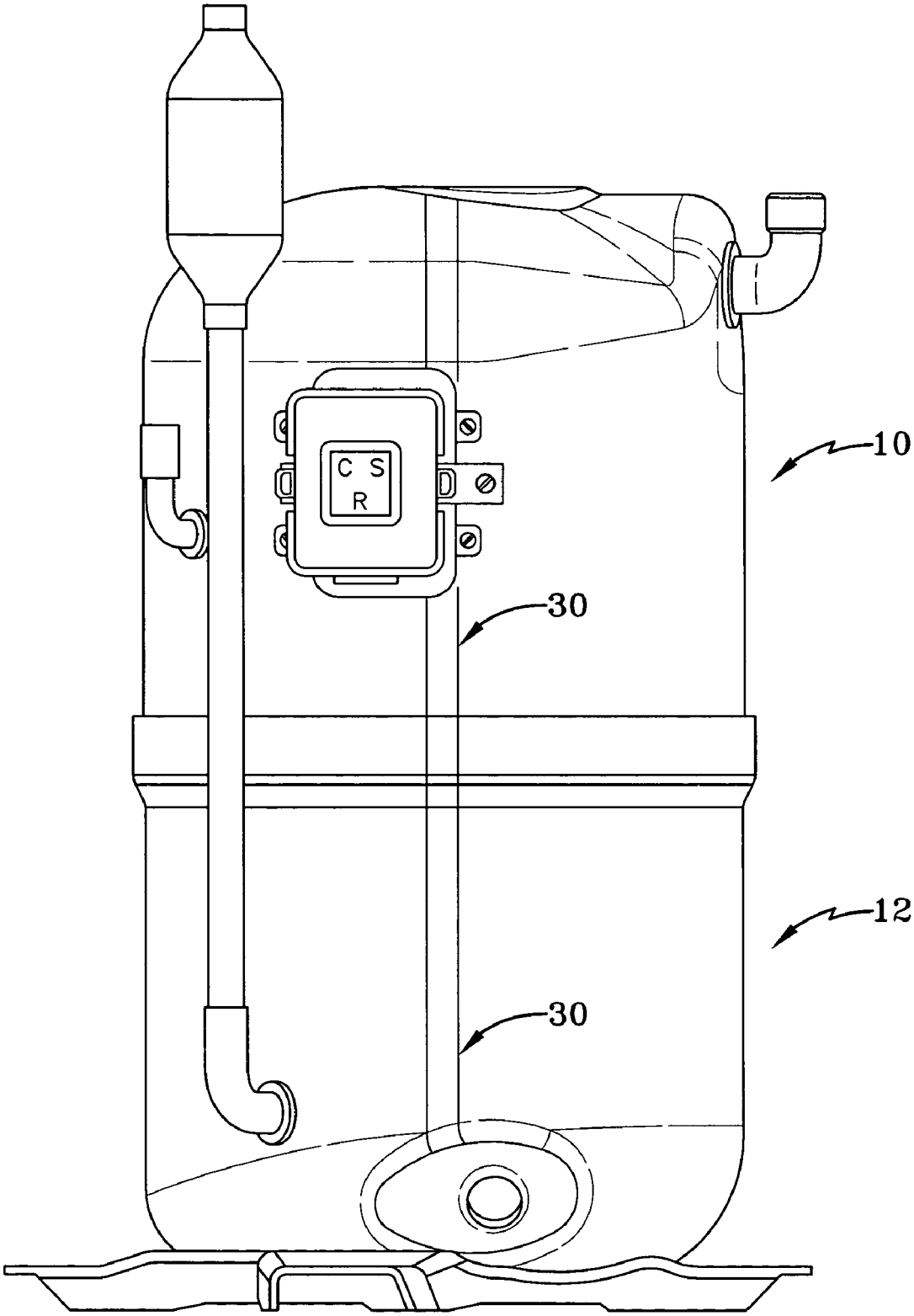
FIG. 14 is a side elevational view of the assembled housing formed by the mating of the upper shell section of FIG. 1 and the lowers shell section of FIG. 3.

With shell alignment completed and maintained, fixtures may now be located and positioned based upon the desired alignment of the shell section, and can be reliably, accurately, and precisely installed. Following installation of any necessary fixtures, aligned shells can be positioned relative to one another for mating and securing of shell sections into a single unit as shown in FIG. 14. Preferably, the force means 42 is such that mating of the sections can be accomplished prior to removing the force means 42. For example, where each shell section 10,12 is aligned by application of force to the exterior shell or sidewall surface wherein the opening 16 of each shell section 10,12 remains unobstructed. the shell sections 10,12 can be mated and the force applying means thereafter can be easily removed. Alternatively, where, due to the shell design or the size, shape or other characteristics of the force applying means, the openings 16 are obstructed and assembly of the shells cannot be accomplished with the force applying means in place, the aligned shell sections may be fixedly positioned using other known external positioning means, such as chocks, dollies, frames, or the like, to maintain alignment during mating of the shells.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A compressor housing having a substantially cylindrical shape with substantially straight sidewalls, the compressor housing comprising an upper section and a lower section, each section comprising an opening, a sidewall, and a closed end portion, the opening of each section having a substantially circular horizontal cross-sectional geometry defined by a major axis and a minor axis, the horizontal cross-sectional geometry having a pair of substantially linear opposing portions, the pair being disposed adjacent to the intersection of the horizontal sectional geometry with the minor axis, the pair of substantially linear opposing sections being disposed substantially perpendicular to the minor axis, the pair of substantially linear opposing sections extending from the opening through the sidewall and into at least part of the closed end portion of each housing section.

2. The compressor housing of claim 1 wherein the substantially circular horizontal cross-section geometry further includes substantially linear opposing sidewall portions disposed adjacent to the intersection of the horizontal sectional geometry with the minor axis.

3. The compressor housing of claim 1, wherein the cross-sectional length of each substantially linear opposing sidewall portion is from about 0.250 inches to about 3.0 inches.

4. The compressor housing of claim 1 wherein the length ratio of the major axis to the minor axis is from greater than 1.0 to about 1.6.

5. The compressor housing of claim 1 wherein the shell sections are comprised of low carbon steel, with sidewall thickness ranging from about 0.090 to about 0.160 inches.

6. The compressor housing of claim 1 wherein the upper shell section is generally cylindrical and is outwardly curved.

7. The compressor housing of claim 1 wherein the lower shell section is generally cylindrical and is outwardly curved.

8. A shell section for a compressor the shell section comprising an opening, a sidewall, and a closed end portion, the opening of each section having a substantially circular horizontal cross-section geometry defined by a major axis and a minor axis, the horizontal cross-section geometry having a pair of substantially linear opposing portions, the pair being disposed adjacent to the intersection of the horizontal sectional geometry with the minor axis, the pair of substantially linear opposing sections being disposed substantially perpendicular to the minor axis, the pair of substantially linear opposing sections extending from the opening through the sidewall and into at least part of the closed end portion.

9. The shell section of claim 8, wherein the cross-sectional length of each substantially linear opposing sidewall portion is from about 0.250 inches to about 3.0 inches.

10. The shell section of claim 8, wherein the length ratio of the major axis to the minor axis is from greater than 1.0 to about 1.6.

11. The shell section of claim 8, wherein the shell sections is comprised of low carbon steel, with sidewall thickness ranging from about 0.090 to about 0.160 inches.

12. The shell section of claim 8, wherein the shell section is an upper shell section which is generally cylindrical and is outwardly curved.

13. The shell section of claim 8, wherein the shell section is a lower shell section which is generally cylindrical and is outwardly curved.

* * * * *

UNITED STATES PATENT AND TRADEMARK OFFICE

CERTIFICATE OF CORRECTION

PATENT NO. : 6,971,860 B2
DATED : December 6, 2005
INVENTOR(S) : Gilliam et al.

It is certified that error appears in the above-identified patent and that said Letters Patent is hereby corrected as shown below:

Title page,
Item [54], Title, "COMPRESSOR UNIT HOUSING" should be -- COMPRESSOR UNIT HOUSING AND METHODS OF ALIGNMENT --.

Column 8,
Line 30, "cross-section" should be -- cross-sectional --.
Line 45, "shell sections" should be -- shell section --.

Signed and Sealed this

Twenty-first Day of February, 2006

JON W. DUDAS
*Director of the United States Patent and Trademark Office*